US005301840A

United States Patent [19]

Sun

[11] Patent Number: 5,301,840

[45] Date of Patent: Apr. 12, 1994

[54] TUBE DISPENSER CAPABLE OF CREATING A SUCKBACK EFFECT IN THE NOZZLE

[75] Inventor: Kai Sun, Warren, N.J.

[73] Assignee: Colgate-Palmolive Company, New York, N.Y.

[21] Appl. No.: 80,999

[22] Filed: Jun. 22, 1993

Related U.S. Application Data

[63] Continuation of Ser. No. 798,310, Nov. 26, 1991, abandoned, which is a continuation-in-part of Ser. No. 682,329, Apr. 8, 1991, abandoned, which is a continuation-in-part of Ser. No. 754,132, Sep. 3, 1991, Pat. No. Des. 338,397.

[51] Int. Cl.[5] ..... B67D 1/16

[52] U.S. Cl. ..... 222/109; 222/156; 222/215

[58] Field of Search ..... 222/154–158, 222/206–215, 107, 108, 109, 571; 220/82 R; 156/272.4; 264/173, 175, 75; 425/133.1, 131.1; D9/302

[56] References Cited

U.S. PATENT DOCUMENTS

| | | | |
|---|---|---|---|
| D. 200,738 | 3/1965 | Scheindel et al. | D9/302 |
| D. 210,818 | 4/1968 | Caliman | D9/302 X |
| D. 289,609 | 5/1987 | Bauwens et al. | D9/302 |
| 1,411,542 | 4/1922 | Van Orsdall | 222/156 |
| 1,537,010 | 5/1925 | Herschmann | 35/2 |
| 2,402,707 | 6/1946 | Stepan | 222/156 X |
| 2,930,063 | 3/1960 | Stull | 15/135 |
| 3,231,156 | 1/1966 | Schultz | 222/569 |
| 3,343,568 | 9/1967 | Branscum et al. | 138/178 |
| 3,356,263 | 12/1967 | Monroe | 222/107 |
| 3,371,822 | 3/1968 | Galloway | 222/95 |
| 3,448,896 | 6/1969 | Kobayashi et al. | 222/568 |
| 3,521,795 | 7/1970 | Langhjelm et al. | 222/386 |
| 3,958,721 | 5/1976 | Kushida et al. | 222/107 |
| 4,261,482 | 4/1981 | Yamada et al. | 222/215 |
| 4,526,297 | 7/1985 | Grimsley | 222/215 X |
| 4,551,371 | 11/1985 | Eckstein | 222/107 X |
| 4,608,285 | 8/1986 | Tavss et al. | 428/35 |
| 4,626,456 | 12/1986 | Farrell et al. | 222/107 X |
| 4,802,833 | 2/1989 | Shapler | 425/131.1 |
| 4,832,211 | 5/1989 | Matthews et al. | 215/1 C |
| 4,874,305 | 10/1989 | McGill et al. | 425/131.1 |

FOREIGN PATENT DOCUMENTS 2101892 3/1972 France .

OTHER PUBLICATIONS

Miscellaneous Trade Advertising.

*Primary Examiner*—Andres Kashnikow
*Assistant Examiner*—Kenneth DeRosa
*Attorney, Agent, or Firm*—Michael J. McGreal; Robert C. Sullivan

[57] ABSTRACT

The tubes of this invention are deformable and will usually not be collapsible. The tubes have a view window and a elongated nozzle. The tubes can be made by blow molding or extrusion. The view window permits a person to determine the contents remaining in the tube and the nozzle provides for ease in dispensing.

10 Claims, 5 Drawing Sheets

TUBE DISPENSER CAPABLE OF CREATING A SUCKBACK EFFECT IN THE NOZZLE

This application is a continuation of application Ser. No. 07/798,310 filed Nov. 26, 1991 now abandoned, which is a continuation in part of U.S. Application Serial No. 07/682,329 file Apr. 8, 1991, now abandoned, and of U.S. Application Serial No. 07/754,132 filed Sept. 3, 1991, now U.S. Pat. No. D 338,397.

This invention relates to tube dispensers for dispensing a variety of personal care and food products. More particularly this invention relates to a tube dispenser which is deformable, has at least one view window and which preferably has a nozzle spout.

Tube dispensers are usually made from an opaque flat laminate sheet or an opaque extruded tubing. The product is dispensed from the spout opening on the shoulder of the tube. Also, there is no view window to determine how much of the contents remain in the tube. This is not a problem with collapsible tubes. Such tubes when compressed retain the compressed shape and provide a clear indication of the amount of product remaining in the tube. However with deformable tubes, which are tubes that regain their original shape after being compressed, it is difficult to determine the contents remaining in a tube after the tube has been through a number of dispensing cycles. A view window on the tube provides a way to know the level of product remaining in the tube.

Tube dispensers also do not have extended nozzles at the exit of the tube portion. A nozzle is an extension which serves to deliver the product a distance above the sidewall and shoulder of the tube. This provides for greater precision in delivering the product from the tube. It also provides for control of the suckback of the product that is being dispensed after pressure is released on the tube and the tube regains its shape. It is desired that the product be sucked back into the nozzle so that it does not cake around the exit opening. This provides for fresher product and a cleaner appearance. A nozzle of particular dimensions is needed for the control of suckback which is caused by the tube regaining its original shape after having been compressed in order to deliver a product.

As has been noted dispensing tubes, such as dentifrice tubes are for the most part of a laminate construction. The laminate tubes replaced the aluminum tubes. Laminate tubes consist of about three or more layers. There is usually an aluminum foil layer with a polymer layer on each side. There can be adhesive layers to bond the polymer layers to the foil. The polymer layers are typically polyethylene layers. There can also be a paper layer which will carry the product information. These laminate tubes are made by forming the laminate sheet into a tube, forming a longitudinal seal where the sheet overlaps and bonding a shoulder—spout to the tube that has been formed. The tube is filled from the bottom and crimp sealed. Laminate tubes have been popular since they emulate the older aluminum tube in that they remain deformed after being compressed to dispense a product.

Extruded tubes have also been used for various personal care and food products. These tubes are formed by extruding the tube portion and bonding the tube portion to the shoulder—spout. The tube is then filled from the bottom and the bottom sealed by a heat crimp seal. Extruded tubes differ from laminate tubes in that the extruded tube will regain its shape after being compressed. This is the case since it will not have a foil layer, which although functioning primarily as barrier, also has the property of staying deformed.

The need for a view window on a tube is with tubes that do not stay deformed. It is difficult to determine the remaining contents of these tubes. View windows are used in plastic bottles such as those that contain motor oil. This permits a person to see the oil remaining in the bottle since the full contents of the bottle will not be used at once. However, view windows have not been used with tubes, and in particular with regard to dentifrice tubes. In addition dentifrice tubes have not had nozzles to deliver the product a distance from the tubular portion of the tube and to control suckback.

The prior art with regard to transparent dentifrice tubes is exemplified by U.S. Pat. No. 493,616, and U.S. Pat. No. 4,376,762. In U.S. Pat. No. 493,616 the tube is made of cellulosic materials and will regain its original shape after the compressing force on the tube is released. The contents of this tube are fully in view. In U.S. Pat. No. 4,376,762 there is shown a transparent tube which displays a dentifrice containing speckles. Since these tubes are fully transparent, or translucent, it is difficult to provide areas for print information. A view window with most of the tube opaque is a more useful tube.

U.S. Pat. No. 3,356,263 discloses a tube having a separate tube section and a separate shoulder and spout portion. These are joined by heat sealing. The tube portion is made by extrusion. U.S. Pat. No. 4,011,968 discloses the general structure of a collapsible tube. This has a laminate multi-layer tube portion and a separate, molded shoulder and spout portion. These are joined by heat sealing. U.S. Pat. No. 4,526,823 discloses the structure of a three layer tube. The three layer structure consists of three plastic layers, each with particular barrier properties. The center layer is disclosed to be an effective oxygen barrier. There is also disclosed the use of adhesive layers to bond the plastic layers.

The prior art with regard to the use of a nozzle on a dispenser is exemplified by U.S. Pat. No. 4,842,165. In this patent there is disclosed a nozzle and a pump dispenser. This pump dispenser has a dentifrice or other product contained in a sack. When the outer wall of the unit is compressed the air contained between the wall and sack is compressed and the product dispensed. There is a nozzle at the top of the dispenser. A valve mechanism in the shoulder region controls the flow of product and the suckback of product. There is no view window in this dispenser.

BRIEF SUMMARY OF THE INVENTION

The present tubes are of a structure where they have one or more view windows and a nozzle at the tube exit. The tubes can be made by blow molding or extrusion, with blow molding being preferred. Blow molding is preferred since the nozzle, shoulder and tube walls can be formed in a single operation. Further, it is possible to create many different shapes.

The tube will have at least one view window running longitudinally along the tube body wall so that the level of contents remaining in the tube can be viewed and determined. This is important for these tubes since they do not stay deformed after being compressed. Tubes that stay deformed provide a constant indication of the amount of product remaining. Further the tube will have a nozzle that can deliver the product in the tube a distance from the shoulder of the tube. This provides for easier control of the product that is being dispensed. This is particularly the case with a dentifrice since it is easier to deposit the paste on a brush that can be held a short distance from the tube shoulder. A nozzle also permits for better control of the suckback features of the tube dispenser.

The tube, whether blow molded or extruded, will be of a multi-layer construction. This is the case since the different layers will serve different purposes. In many instances one layer will be a moisture barrier layer and another layer an organic barrier layer. The moisture barrier layer will prevent the product from becoming dried out and the organic barrier layer will help maintain the rheological and organoleptic properties of the product. In addition one or more layers will function as seal layers so that seals can be formed if necessary.

DETAILED DESCRIPTION OF THE INVENTION

Figure 1:
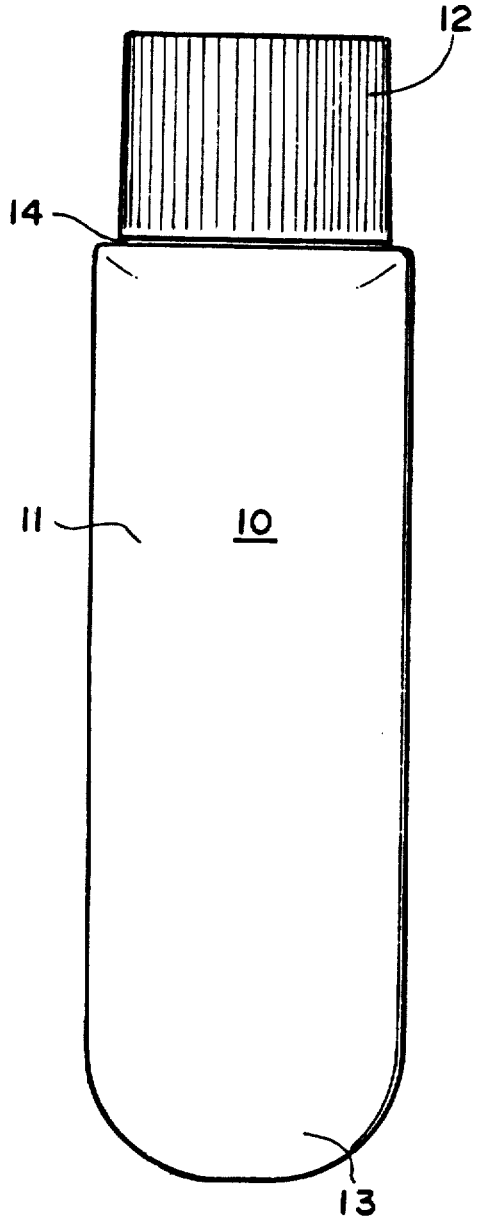
FIG. 1 is a front elevational view of a tube dispenser having a continuous bottom.

The present tubes are preferably made by blow molding. In this way the nozzle, shoulder and walls can be formed in a single operation. This would be the case even when the tube is to have an open bottom end and is to be filled through the open bottom end. Although the tube can be blown in a single piece, including the bottom, this is not feasible when the tube is to be used for a paste-like substance such as a dentifrice. It would not be feasible to fill a tube through the small nozzle opening. The filling time would be prohibitively long. Thus in blow molding the tubes would be blown without either the upper nozzle portion or without the permanent lower bottom portion depending on whether they are to be bottom or top filled. When blow molded without the nozzle portion the tube would be filled from the top and a nozzle fitment attached. When blow molded without the permanent bottom portion the tube will be filled from the bottom and crimp sealed.

The tubes can also be formed by extrusion. When formed by extrusion the tube will be extruded in a continuous length and cut into sections of the desired length. The shoulder—nozzle portions will be separately formed by injection molding or an equivalent technique. Then in a separate step the shoulder is heat sealed to the tube. The tube is open at the bottom and is thus bottom filled. After filling the bottom is sealed by a crimp heat seal.

In the use of either blow molding or extrusion the tubes are provided with at least one view window and a nozzle. The view window is a clear or substantially clear transparent stripe longitudinally along the tube wall. This can be along any wall of the tube. It need only be of a clarity, width and length so that the amount of contents remaining in a tube can be determined. In most instances the tube will be opaque with a narrow view window. The tube will usually be opaque since it is easier to put printed instructions and decorations onto an opaque surface. The view window will be from about 0.20 to 2.0 centimeters in width. Preferably the view window is about 0.35 to 1 cm in width. It will usually be of the same material as the opaque portion, but with the opacifying substances deleted from the formulation. Whether the tube is made by blow molding or extrusion the view window is formed at the same time as the remainder of the tube wall.

As has been discussed the nozzle will be separately formed when the tube is to be formed by extrusion. When the tube is to be blow molded the nozzle will be formed along with the tube walls for a bottom filled unit and produced as a separate fitment for a top filled unit. In any case the nozzle will extend about 1 to 2.5 cm about the shoulder and have a dispensing opening of about 0.25 to 1 cm. Thus the nozzle height to dispensing opening ranges from 1:1 to 10:1. The nozzle exterior surface will preferably carry threads for the attachment of a cap. The preferred cap is one that has a diameter approximating that of the tube so that the tube can stand upright on the cap.

FIG. 1 shows the blow molded tube 10 which has a front side 11, continuous bottom portion 13 and cap 12. The junction between the cap and body is shown at 14. This tube is continuous through its body portion including lower portion 13. There are no crimp, heat or adhesive seals at 13. This tube is to be filled from the top opening. The nozzle was not formed in the blow molding process.

Figure 2:
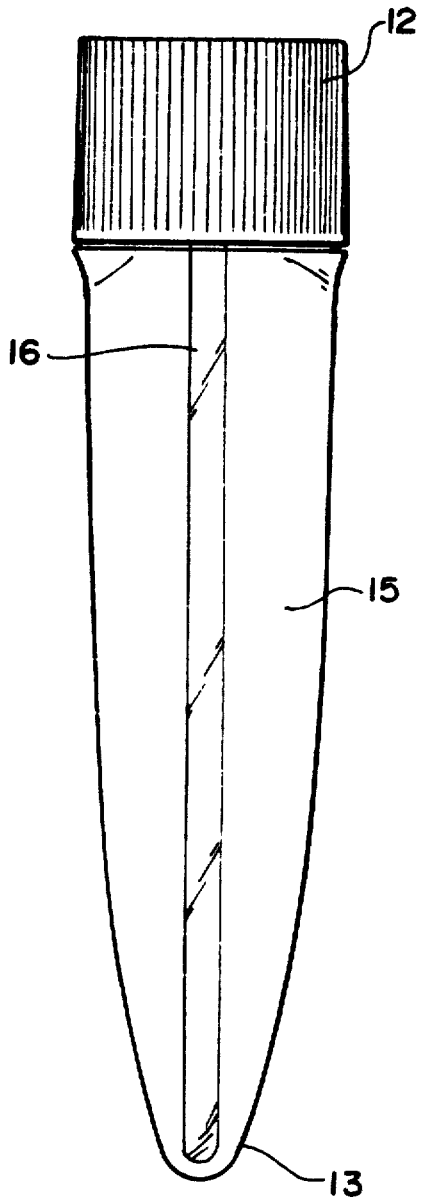
FIG. 2 is a side elevational view of the tube dispenser showing the view window.

FIG. 2 is a side view of the tube showing side 15 with view window 16. The material of the tube is opaque except for the view window. The view window extends from the bottom of the tube to the top of the tube. The view window is comprised of the same plastic material as the rest of the tube.

Figure 3:
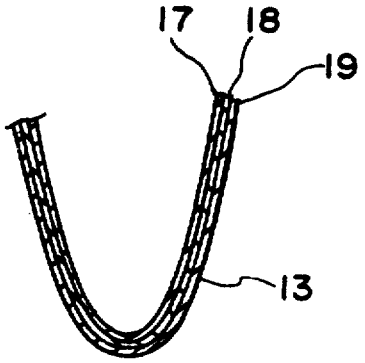
FIG. 3 is a sectional view of the tube of FIG. 1 showing a multilayer structure.

FIG. 3 depicts a multi-layer structure for this tube. This is a cutaway of the bottom of the tube. Layer 17 is a moisture barrier and layer 18 an organic barrier. Layer 19 is a combination protective and print layer. The moisture barrier is preferably a polyolefin, and most preferably a low density polyethylene or a polypropylene. The organic barrier layer will be a layer such as ethylene-vinyl alcohol. The outer protective print layer will likewise preferably be a polyolefin. It can be the same or different from the inner layer. In a preferred embodiment for a dentifrice tube the layer adjacent the dentifrice will be low density polyethylene of a thickness of about 75 to 200 microns, preferably about 100–150 microns, and most preferably about 125 microns. The next layer will be the ethylene-vinyl alcohol organic barrier layer. This will be in a thickness of about 15 to 40 microns, and preferably about 25 microns. The outer layer will also be a low density polyethylene layer and will have a thickness of about 200 to 400 microns, preferably about 250 to 325 microns and most preferably about 280 microns. Between each layer there can be an adhesive having a thickness of about 5 to 25 microns, and preferably about 10 to 15 microns. Suitable adhesives are ethylene—acrylic acid copolymers and ethylene—vinyl acetate copolymers.

The polymer layers besides providing the moisture barrier and the organic barrier also provide the structural properties of the tube. The tube wall should rapidly return to its original shape when the compressing pressure is released. Also the tube wall should not show any permanent creases or deflections. The tube wall must be flexible and have a memory so as to return its original shape. Thus the plastic components of the tube wall must be able to provide this memory. Low density polyethylene and polypropylene exhibit this property. High density polyethylene does not have a sufficient memory to be used as one of the layers. It can result in permanent creases and permanent deflections. However, it can be used in combination with low density polyethylene in an amount of about up to 50 percent by weight, and preferably up to about 25 percent by weight.

The memory of the tube sidewall must be sufficient to produce an essentially simultaneous suckback of product at the nozzle exit. The suckback should be at least about 0.3 cm and preferably at least about 0.6 cm down into the nozzle.

Figure 4:
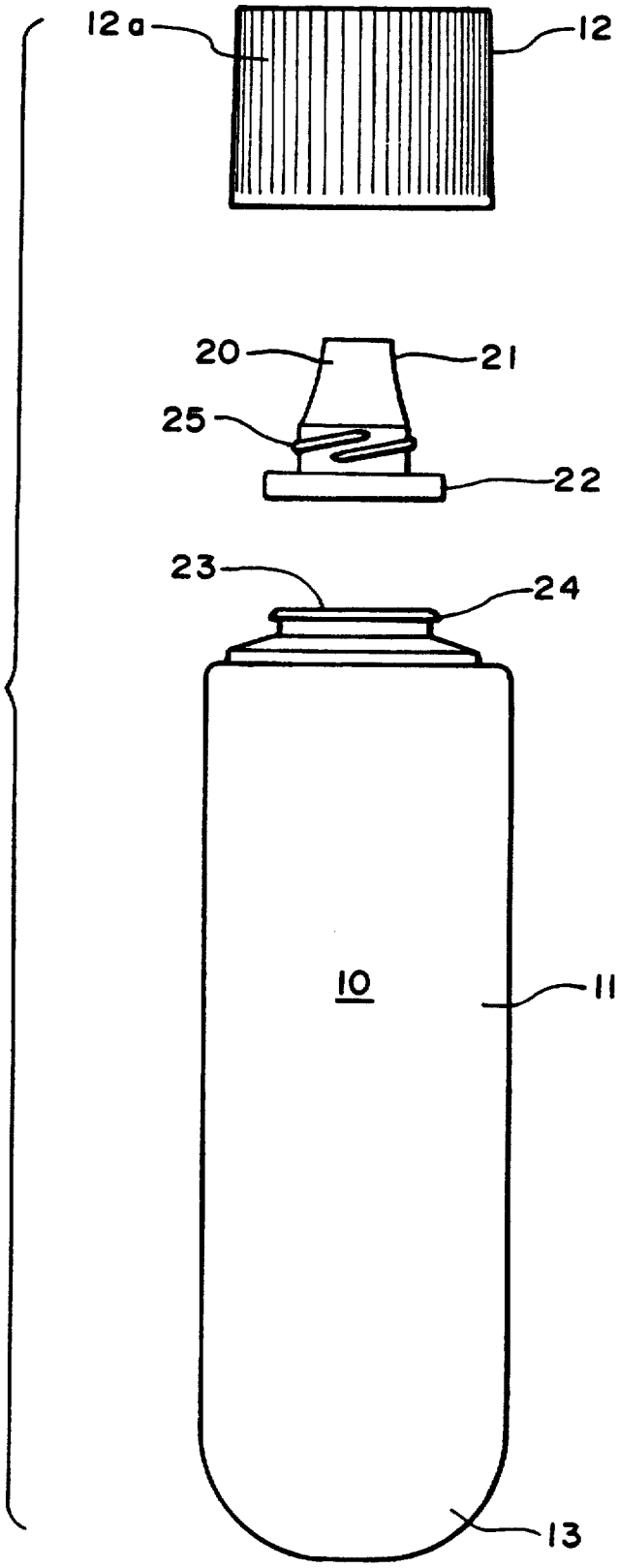
FIG. 4 is an exploded view of the tube dispenser showing the dispensing fitment and cap.

FIG. 4 is an exploded view of the full tube dispenser. This has the tube portion 10, fitment 20 and cap 12. The cap has grip roughening grooves 12(*a*). The fitment consists of spout 21 which has a lower attachment region 22. The tube is shown having opening 23. Lip 24 of the tube interacts with a groove in the fitment to keep the fitment secured to the tube. Threads 25 on the fitment cooperate with threads in the cap to keep the cap on the fitment. The cap is of a size so that the tube can be inverted and can then be supported on the cap.

Figure 5:
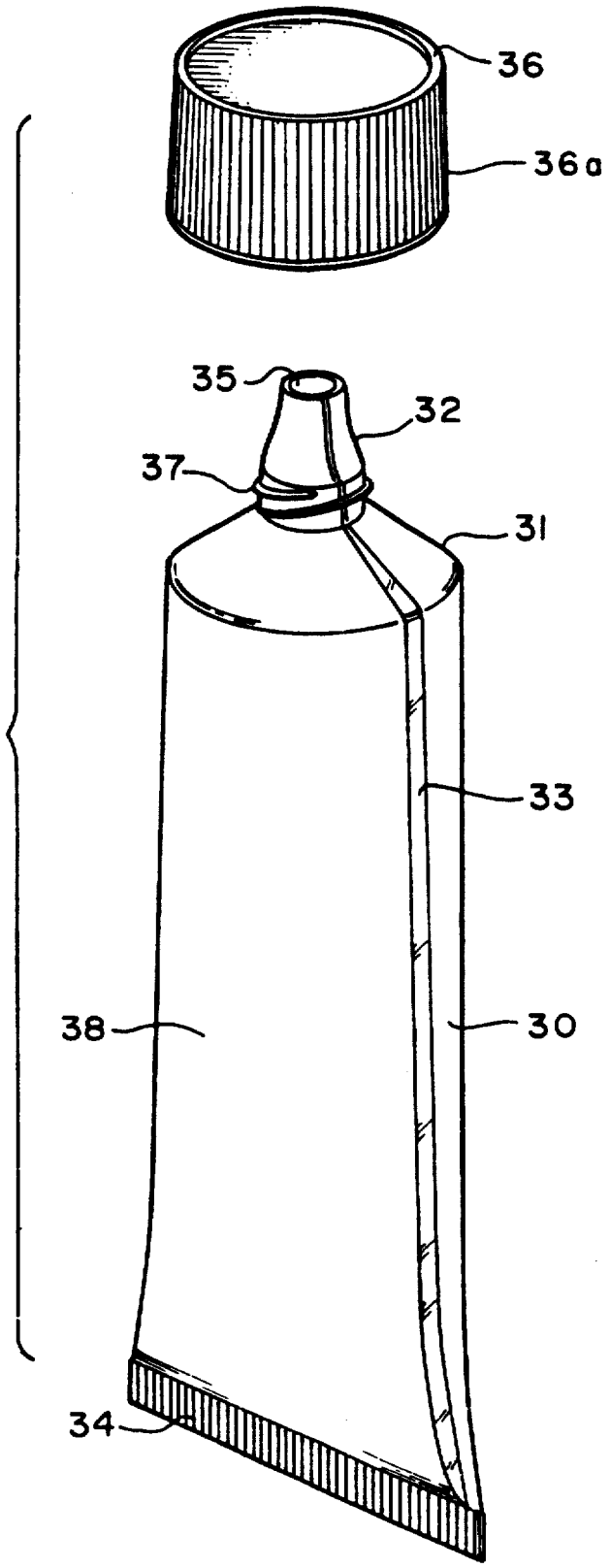
FIG. 5 is an exploded view of an embodiment of the tube which has a crimp sealed bottom.
Figure 6:
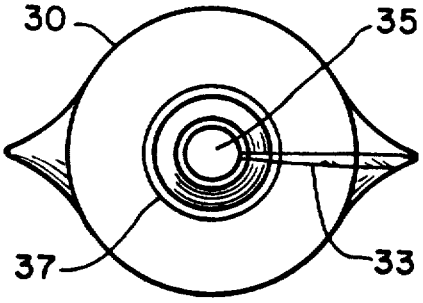
FIG. 6 is top plan view of the tube of FIG. 5.
Figure 7:
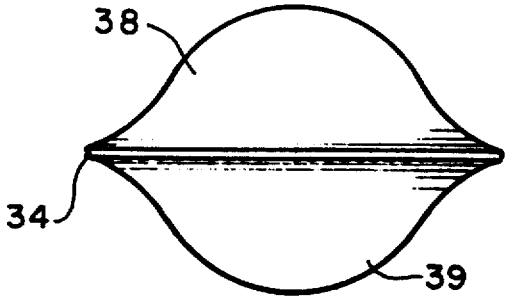
FIG. 7 is a bottom plan view of the tube of FIG. 5.
Figure 8:
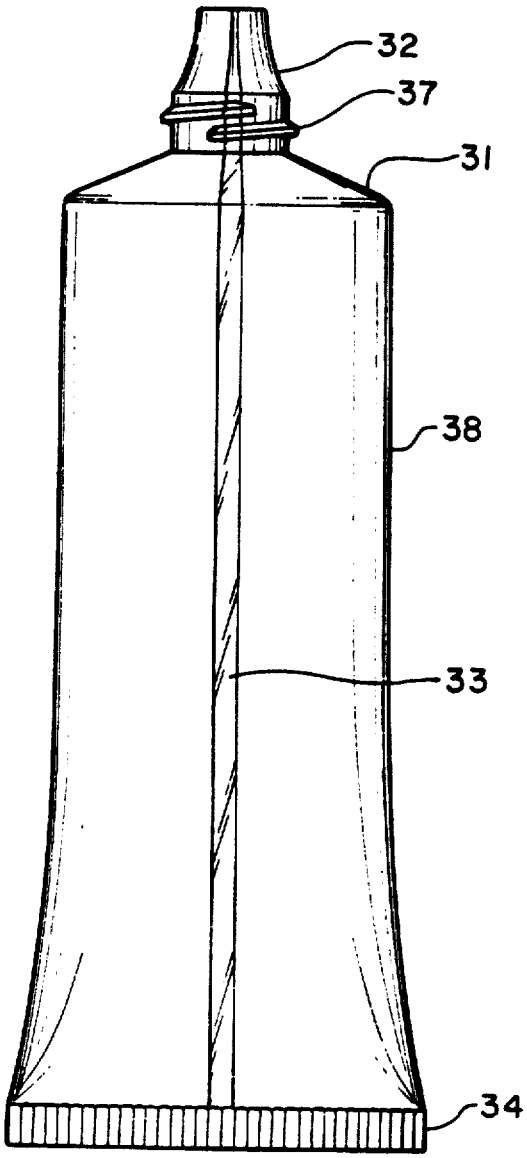
FIG. 8 is a front or rear view of the tube of FIG. 5 showing the view window in the front or rear wall.
Figure 9:
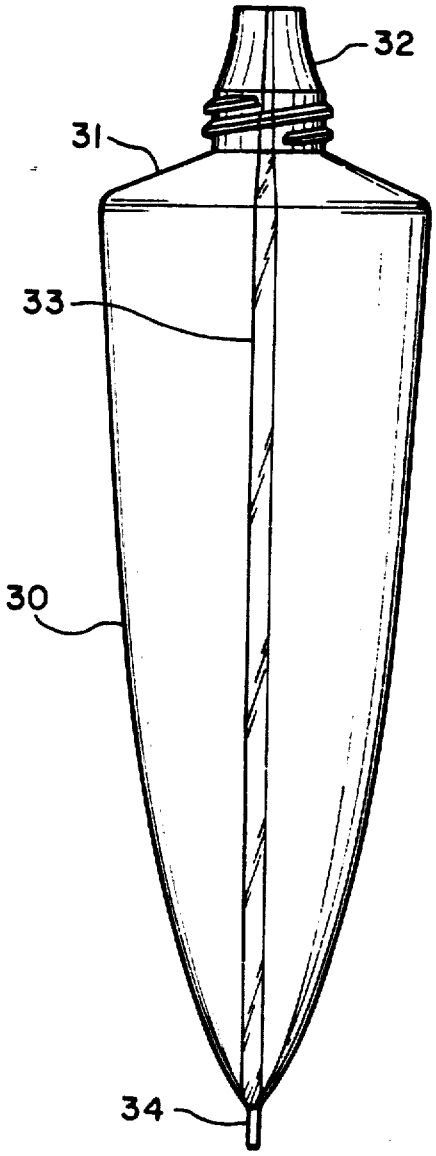
FIG. 9 is a side view of the tube of FIG. 5 with the view window in the sidewall.

FIG. 5 shows the embodiment of the tube where the tube 30 shoulder 31 and nozzle 32 are blow molded as a single piece. The bottom is open when molded or comprised of flashing that is cut off to open the bottom end. The view window 33 extends up the side, across the shoulder and in a narrow band up the nozzle 32. The nozzle has opening 35 and treads 37 for holding cap 36 on the tube. The cap has griping serrations 36 (a). The cap is essentially the same diameter as the tube. In this way the tube can stand on the cap when inverted. The bottom of the tube is crimp heat sealed at 34 after the tube has been filled from the bottom. The front surface is designated as 38. FIG. 6 shows a top plan view of the tube without the cap. A bottom plan view is shown in FIG. 7. The rear surface of the tube is designated as 39. In FIG. 8 there is shown the embodiment of the tube having the view window 33 in the front wall 38. In FIG. 9 the view window 33 is shown as being on a sidewall.

Figure 10:
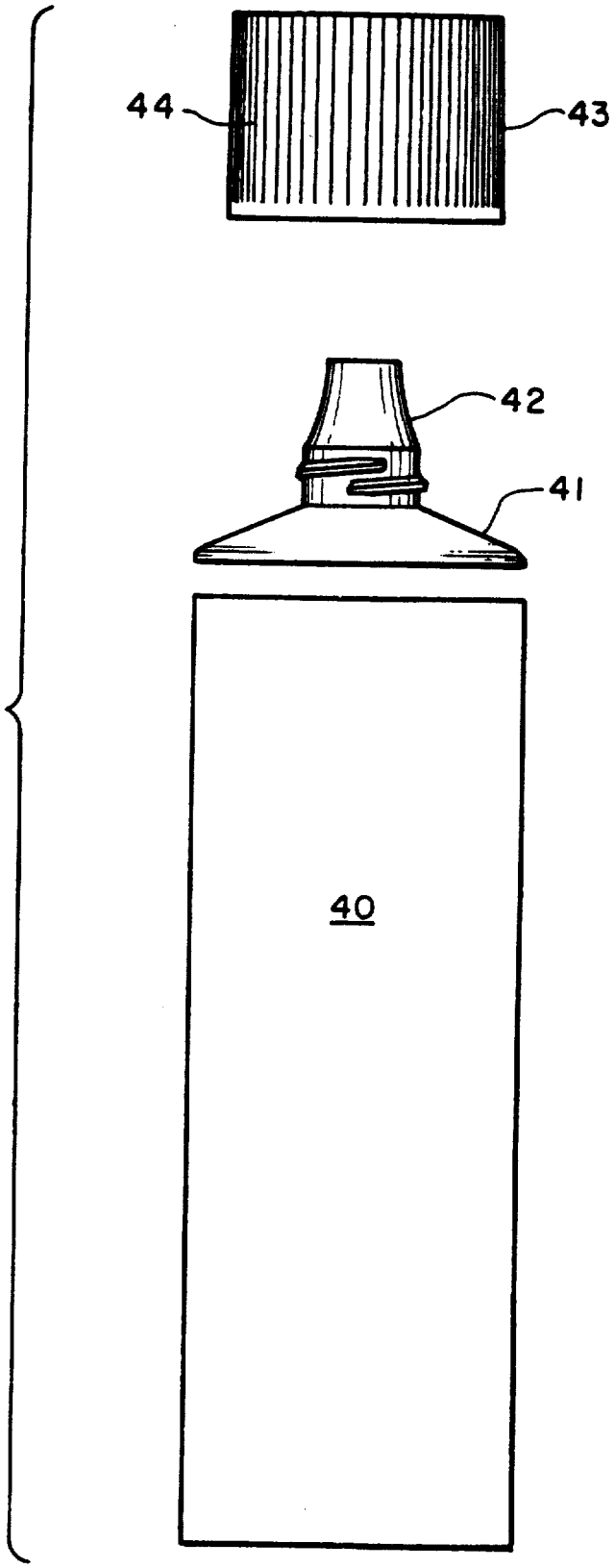
FIG. 10 is an exploded view of the components of an extruded tube.

In FIG. 10 there is shown a tube that has been made by extrusion. In this instance the tube wall 40 has been continuously extruded and severed. The shoulder 41 and nozzle 42 are separately produced by injection molding. This shoulder and nozzle are heat sealed to the extruded tube body 40, filled with a product such as a dentifrice, and then crimp heat sealed at the bottom edge. The cap 43 has serrations 44.

In all embodiments where the tube is filled from the bottom it is filled with the cap in place. The cap keeps product from escaping from the nozzle during filling. When filled from the top the tube is filled and than the nozzle fitment put into place. The tubes are then placed in cartons for shipping.

What we claim is:

1. A tube dispenser comprising a continuous tube portion, a conical shoulder on one end of said tube portion and the other end of said tube portion being closed, said shoulder having a nozzle which extends away from said tube portion and having an aperture to deliver substances being dispensed from said tube, the ratio of the height of said nozzle to the diameter of said aperture being from about 1:1 to 10:1, the continuous tube portion having a multilayer structure with sufficient memory such that when the tube portion is compressed to deliver a product the tube portion rapidly regains its original shape upon the release of compression on the tube portion to thereby create a suckback to draw product in the nozzle opening downwardly at least about 0.3 cm, said multilayer structure comprised of an inner moisture barrier layer having a thickness of about 75 microns to 200 microns, an organic barrier layer having a thickness of about 15 to 40 microns and an outer protective layer having a thickness of about 200 to 400 microns, said outer protective layer being a low density polyethylene layer having a high density polyethylene content of up to about 50 percent by weight.

2. A tube dispenser as in claim 1 wherein said organic barrier layer is ethylene vinyl alcohol.

3. A tube dispenser as in claim 2 wherein said moisture barrier layer is a layer of low density polyethylene.

4. A tube dispenser as in claim 3 wherein moisture barrier layer has a thickness of about 100 to 150 microns and said protective layer has a thickness of about 250 to 325 microns.

5. A tube dispenser as in claim 3 wherein between each layer there is a layer of an adhesive having a thickness of about 5 to 25 microns.

6. A tube dispenser as in claim 5 wherein the multilayer structure of said tube portion creates a suckback sufficient to draw product in the nozzle opening downwardly at least about 0.6 cm.

7. A tube dispenser as in claim 1 wherein the high density polyethylene content of said protective layer is up to about 25 percent by weight.

8. A tube dispenser as in claim 1 wherein said nozzle extends about 1 cm to 2.5 cm above the tube portion shoulder.

9. A tube dispenser as in claim 1 wherein said tube portion is crimp sealed at the bottom other end thereof and has a view window extending longitudinally along the surface of said tube.

10. A tube dispenser as in claim 9 wherein said view window has a width of about 0.2 to 2 cm.

* * * * *